US010465903B2

(12) United States Patent
Wang et al.

(10) Patent No.: US 10,465,903 B2
(45) Date of Patent: Nov. 5, 2019

(54) BURNER

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Cheng Wang, Foshan (CN); Guangwu Wang, Foshan (CN); Shiping Zhu, Foshan (CN); Guosheng Shi, Foshan (CN)

( * ) Notice: Subject to any disclaimer, the term of this patent is extended or adjusted under 35 U.S.C. 154(b) by 182 days.

(21) Appl. No.: 15/557,820

(22) PCT Filed: Jun. 23, 2015

(86) PCT No.: PCT/CN2015/082053

§ 371 (c)(1),
(2) Date: Sep. 13, 2017

(87) PCT Pub. No.: WO2016/145745

PCT Pub. Date: Sep. 22, 2016

(65) Prior Publication Data

US 2018/0045406 A1 Feb. 15, 2018

(30) Foreign Application Priority Data

Mar. 13, 2015 (CN) ..... 2015 1 0111488
Mar. 13, 2015 (CN) ..... 2015 2 0146279 U

(51) Int. Cl.
*F23D 14/04* (2006.01)
*F23D 14/46* (2006.01)
*F24C 3/08* (2006.01)

(52) U.S. Cl.
CPC ..... *F23D 14/04* (2013.01); *F23D 14/46* (2013.01); *F24C 3/082* (2013.01); *F23D 2203/007* (2013.01); *F23D 2900/14063* (2013.01)

(58) Field of Classification Search
CPC ..... F23D 14/04; F23D 14/46; F24C 3/08
(Continued)

(56) References Cited

U.S. PATENT DOCUMENTS 2,497,787 A 2/1950 Minster
3,658,089 A * 4/1972 Wine ..... B65D 88/54 137/590
(Continued)

FOREIGN PATENT DOCUMENTS

CN 2791482 Y 6/2006
CN 102 906 501 A 1/2013
(Continued)

OTHER PUBLICATIONS

International search report dated Dec. 23, 2015 in the corresponding Chinese application (application No. PCT/CN2015082053).
(Continued)

*Primary Examiner* — Edelmira Bosques
*Assistant Examiner* — Nikhil P Mashruwala
(74) *Attorney, Agent, or Firm* — Kilpatrick Townsend & Stockton

(57) ABSTRACT

A burner comprising a base cup, an annular flame splitter, and a flame cover. The base cup comprises an air inlet channel and two nozzles in communication with the air inlet channel and arranged upwards. The annular flame splitter arranged on the base cup comprises two Venturi tubes respectively arranged opposite the two nozzles. The annular flame splitter is separated from the base cup to form a gap, thus allowing primary air to enter the two Venturi tubes from the gap to be mixed with a fuel gas sprayed into the two Venturi tubes by the two nozzles to form a gaseous mixture. Groove openings are formed on the top of the annular flame splitter in communication with the mixing cavity. The flame cover covers the mixing cavity and limits the groove open-
(Continued)

ings to define the outlet for the gaseous mixture, thus forming a flame ring.

10 Claims, 4 Drawing Sheets

(58) Field of Classification Search
USPC ..... 126/39 E, 3 N, 214 R
See application file for complete search history.

(56) References Cited

U.S. PATENT DOCUMENTS

| | | | | |
|---|---|---|---|---|
| 4,835,965 | A * | 6/1989 | Poehlman | F02B 27/04 60/313 |
| 6,332,460 | B1 * | 12/2001 | Paesani | F23D 14/06 126/39 R |
| 6,343,927 | B1 * | 2/2002 | Eroglu | F15C 1/22 239/101 |
| 8,747,108 | B2 * | 6/2014 | Lona Santoyo | F23D 14/06 126/39 B |
| 9,127,838 | B2 * | 9/2015 | Paesani | F23D 14/065 |
| 2006/0035184 | A1 * | 2/2006 | D'Agostini | C03B 5/2353 431/10 |
| 2009/0162801 | A1 | 6/2009 | McCrorey et al. | |
| 2009/0165777 | A1 | 7/2009 | Cadima et al. | |
| 2009/0320823 | A1 | 12/2009 | Padgett | |
| 2010/0206293 | A1 | 8/2010 | Padgett et al. | |
| 2011/0290231 | A1 * | 12/2011 | Padgett | F23D 14/06 126/215 |
| 2014/0209088 | A1 * | 7/2014 | Bettinzoli | F23D 14/06 126/39 E |
| 2017/0370576 | A1 * | 12/2017 | Fang | F23D 14/58 |

FOREIGN PATENT DOCUMENTS

| | | | |
|---|---|---|---|
| CN | 102906501 | A | 1/2013 |
| EP | 2 551 589 | A2 | 1/2013 |
| EP | 2733422 | A1 | 5/2014 |
| WO | 2006/114063 | A1 | 11/2006 |

OTHER PUBLICATIONS

Korean Office Action dated Nov. 12,2018 in the corresponding KR application (application No. 10-2017-7027520).
European Search Report for EP 15 88 5128 dated Aug. 22, 2018, all pages.

* cited by examiner

BURNER

CROSS-REFERENCE TO RELATED APPLICATION

This application is a national phase entry under 35 USC § 371 of International Application PCT/CN2015/082053, filed Jun. 23, 2015, which claims priority to and benefits of Chinese Patent Applications Serial No. 201510111488.X and 201520146279.4, filed with the State Intellectual Property Office of P. R. China on Mar. 13, 2015, the entire contents of which are incorporated herein by reference.

FIELD

The present disclosure relates to a technology of gas stoves, and more particularly to a burner for a gas stove.

BACKGROUND

An existing burner is provided with a plurality of flame rings, and mixing chambers corresponding to the plurality of flame rings are intercommunicated, such that a mixed gas of fuel gas and air may circulate among the mixing chambers, and hence a mutual interference is prone to be generated among the plurality of flame rings. In addition, the burner also needs to be provided with a plurality of venturi tubes for supplying the mixed gas to the mixing chambers corresponding to the plurality of flame rings respectively, while a production process of the venturi tube is complicated, thereby resulting in an increased cost of the burner.

SUMMARY

Embodiments of the present disclosure seek to solve at least one of the problems existing in the related art to at least some extent. For this reason, a burner is provided by the present disclosure.

The burner according to a preferable embodiment of the present disclosure includes:

a bottom cup having a gas input passage and two nozzles communicated with the gas input passage and disposed upwards;

a ring-shaped flame distributor disposed to the bottom cup and including two venturi tubes respectively opposite to the two nozzles, the flame distributor being spaced apart from the bottom cup to define a gap therebetween, such that a primary air is allowed to enter the two venturi tubes through the gap to mix with a fuel gas sprayed into the two venturi tubes from the two nozzles so as to form a mixed gas, the flame distributor being provided with a ring-shaped mixing chamber communicated with the venturi tubes, and having a notch formed at a top portion of the flame distributor and communicated with the mixing chamber; and a burner cover disposed to the flame distributor, the burner cover being configured to cover the mixing chamber and limit the notch to define an outlet of the mixed gas, thereby forming a flame ring.

The burner according to the preferable embodiment of the present disclosure just adopts the mixing chamber and the corresponding flame ring, such that there is no case that such flame ring is interfered with other flame rings due to a communication of such mixing chamber with other mixing chambers. In addition, the venturi tubes for supplying the mixed gas to the other mixing chambers may also be omitted, thereby reducing the cost.

In some embodiments, the gas input passage is configured to have a straight line shape, and the flame distributor presents a circular-ring shape, a middle axis of the gas input passage passes through a center axis of the flame distributor, and the two nozzles are respectively disposed at two sides of the center axis of the flame distributor.

In some embodiments, the gas input passage is substantially Y-shaped and includes two end points, the flame distributor presents a circular-ring shape, a connection line between the two end points passes through a center axis of the flame distributor, and the two nozzles are disposed at the two end points respectively.

In some embodiments, the gas input passage further includes a connection passage connecting the two end points with each other.

In some embodiments, the two nozzles and the two venturi tubes are vertically disposed.

In some embodiments, the bottom cup includes two cup portions, the two nozzles are provided in the cup portions respectively, the flame distributor includes two blocking hems, and the two hems are corresponding to and flush with top edges of the two cup portions respectively, the bottom cup or the flame distributor includes a spacer configured to space the two blocking hems apart from the top edges of the two cup portions.

In some embodiments, a dimension of the blocking hem is larger than that of the top edge of the bottom cup.

In some embodiments, the venturi tube extends into the cup portion.

In some embodiments, the flame distributor includes two partition structures disposed in the mixing chamber and configured to divide the mixing chamber into two separate sub-chambers, and the two venturi tubes are respectively communicated with the two sub-chambers.

In some embodiments, the gas input passage includes two separate sub-passages, and the two nozzles are respectively disposed to the two separate sub-passages.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the descriptions made with reference to the following drawings.

DETAILED DESCRIPTION

Figure 1:
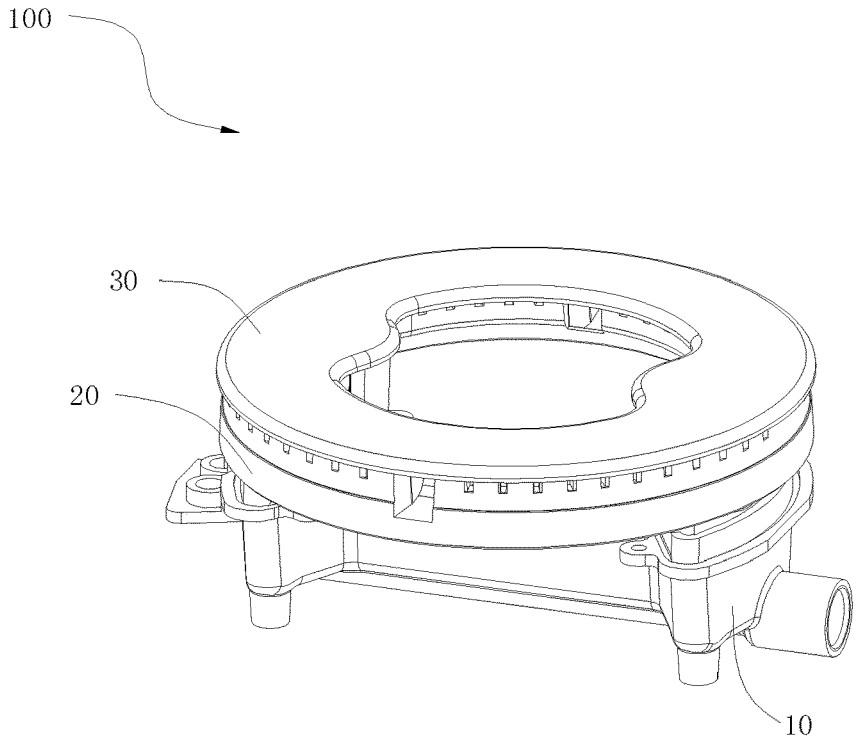
FIG. 1 is a schematic perspective view of a burner according to a preferable embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, and used to generally understand the present disclosure. The embodiments shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

Figure 2:
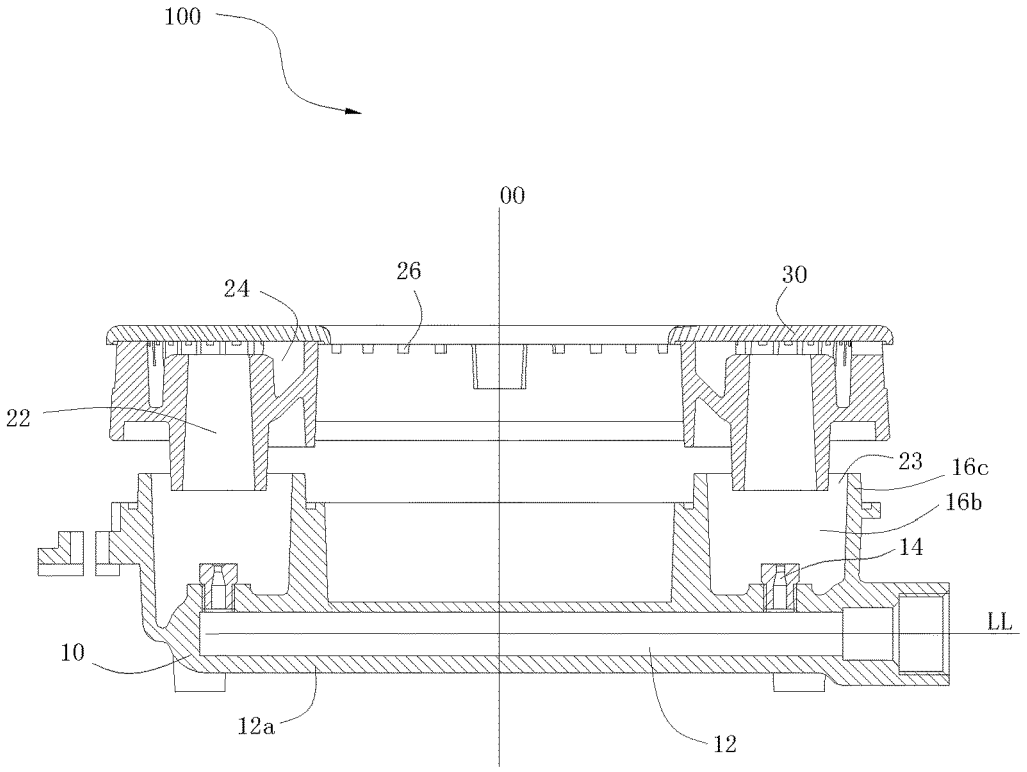
FIG. 2 is a sectional view of the burner illustrated in FIG. 1.

Referring to FIGS. 1 and 2, a burner 100 according to a preferable embodiment of the present disclosure includes a bottom cup 10, a ring-shaped flame distributor 20 and a burner cover 30. The bottom cup 10 includes a gas input passage 12 and two nozzles 14 communicated with the gas input passage 12 and arranged upwards. The flame distributor 20 is provided to the bottom cup 10, and the flame distributor 20 includes two venturi tubes 22 opposite to the two nozzles 14 respectively. The flame distributor 20 is spaced apart from the bottom cup 10 to define a gap 23 therebetween, thereby allowing a primary air to enter the two venturi tubes 22 through the gap 23, so as to mix with a fuel gas sprayed into the two venturi tubes 22 from the two nozzles 14 to form a mixed gas. The flame distributor 20 is provided with a ring-shaped mixing chamber 24 communicated with the venturi tubes 22 and also has a notch 26 formed at a top portion of the flame distributor 20 and communicated with the mixing chamber 24. The burner cover 30 is disposed to the flame distributor 20, and covers the mixing chamber 24 and limits the notch 26 to define an outlet of the mixed gas, thereby forming a flame ring.

The burner 100 according to the preferable embodiment of the present disclosure just adopts the mixing chamber 24 and the corresponding flame ring, such that there is no case that such flame ring is interfered with other flame rings due to a communication of such mixing chamber 24 with other mixing chamber. In addition, the venturi tubes for supplying the mixed gas to the other mixing chambers may be omitted, thereby reducing the cost.

That is, the burner 100 according to the preferable embodiment of the present disclosure just includes the ring-shaped mixing chamber 24 (i.e., equivalent to an outer-ring mixing chamber of an existing burner), but does not further include an inner-ring mixing chamber communicated with the outer-ring mixing chamber and used for producing an inner flame ring, like the existing burner. In addition, since the inner-ring mixing chamber is omitted with respect to the existing burner, the venturi tubes of the existing burner for supplying the inner-ring mixing chamber with the mixed gas may also be omitted.

In some embodiments, the gas input passage 12 is configured to have a straight line shape, and the flame distributor 20 presents a circular-ring shape. A middle axis LL of the gas input passage 12 passes through a center axis OO of the flame distributor 20, and the two nozzles 14 are respectively disposed at two sides of the center axis OO.

In the above configuration, since the gas input passage 12 is configured to have the straight line shape, a simple structure, an easy molding and a convenient assembling are provided. Moreover, the two nozzles 14 are located at two ends of a diameter of the flame distributor 20, such that the mixed gas is evenly supplied to the mixing chamber 24.

Figure 3:
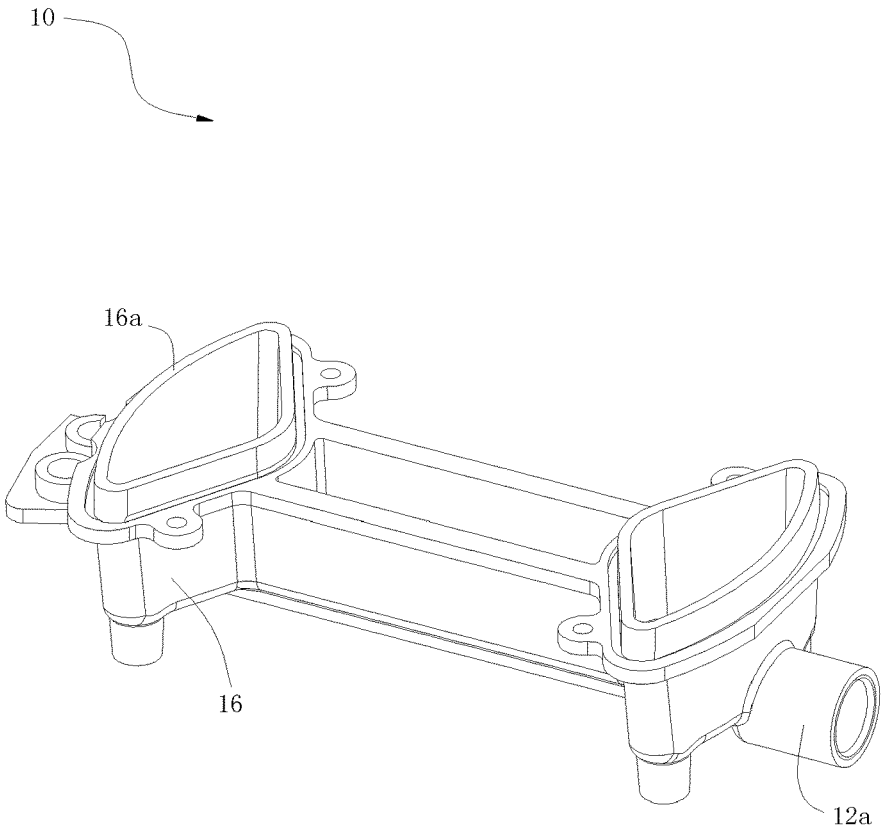
FIG. 3 is a schematic perspective view of a bottom cup of the burner illustrated in FIG. 1.

Referring to FIG. 3, in the present embodiment, the bottom cup 12 includes a gas input tube 12*a* having a straight line shape and basically arranged horizontally. The gas input tube 12*a* defines the gas input passage 12 therein, and the two nozzles 14 are provided to the gas input tube 12*a*. The fuel gas is input from an end of the gas input tube 12*a*, fed to one of the nozzles 14, and then continues moving forwards to be fed to the other one of the nozzles 14.

Figure 4:
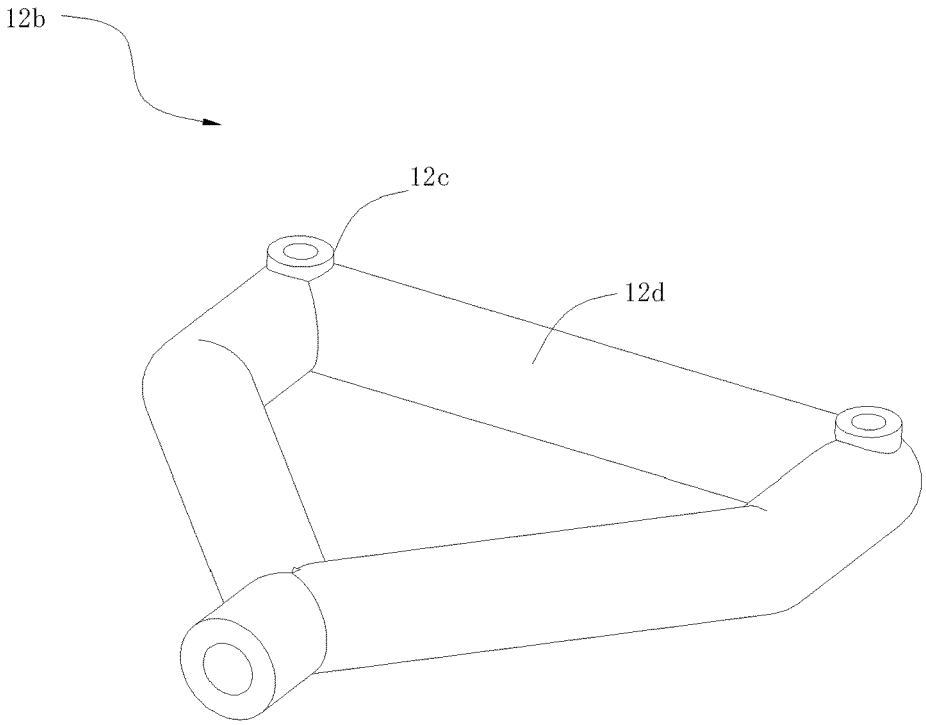
FIG. 4 is a schematic perspective view of a gas input passage of a bottom cup according to another embodiment of the present disclosure.

Referring to FIG. 4, in some embodiments, the gas input passage 12*b* is basically Y-shaped and includes two end points 12*c*. The flame distributor 20 presents a circular-ring shape, a connection line between the two end points 12*c* passes through a middle axis OO of the flame distributor 20, and the two nozzles 14 are disposed at the two end points 12*c* respectively.

In the above configuration, the fuel gas arrives at the two nozzles 14 by equal distances and the fuel gas possess same pressures at the two nozzles, such that an even gas supply of the two nozzles may be achieved, thereby improving uniformity of the flame ring. Moreover, the two nozzles 14 are disposed at the two ends of the diameter of the flame distributor 20, such that the mixed gas may be evenly supplied to the mixing chamber 24, thereby further improving the uniformity of the flame ring.

In the present embodiment, the gas input passage 12*b* further includes a connection passage 12*d* connecting the two end points 12*c*.

Thus, the fuel gas may circulate in the gas input passage 12*b*. That is, when the fuel gas arrives at and is fed to one of the nozzles 14, the rest fuel gas may continue advancing through the connection passage 12*d* under pressure, so as to arrive at and be fed to the other one of the nozzles 14, such that the fuel gas may be utilized efficiently.

Certainly, the gas input passage is not limited to the above embodiments, and an appropriate shape and structure may be adopted according to requirements in the other embodiments.

In some embodiments, the two nozzles 14 and the two venturi tubes 22 are vertically disposed.

As a density of the fuel gas is low, by means of such configuration, efficiency of the two nozzles 14 spraying the fuel gas into the two venturi tubes 22 may be improved, thereby improving a supply efficiency of the fuel gas.

Certainly, arrangements of the two nozzles 14 and the two venturi tubes 22 are not limited to the present embodiment, but the two nozzles 14 and the two venturi tubes 22 may be arranged inclinedly according to requirements in other embodiments.

Figure 5:
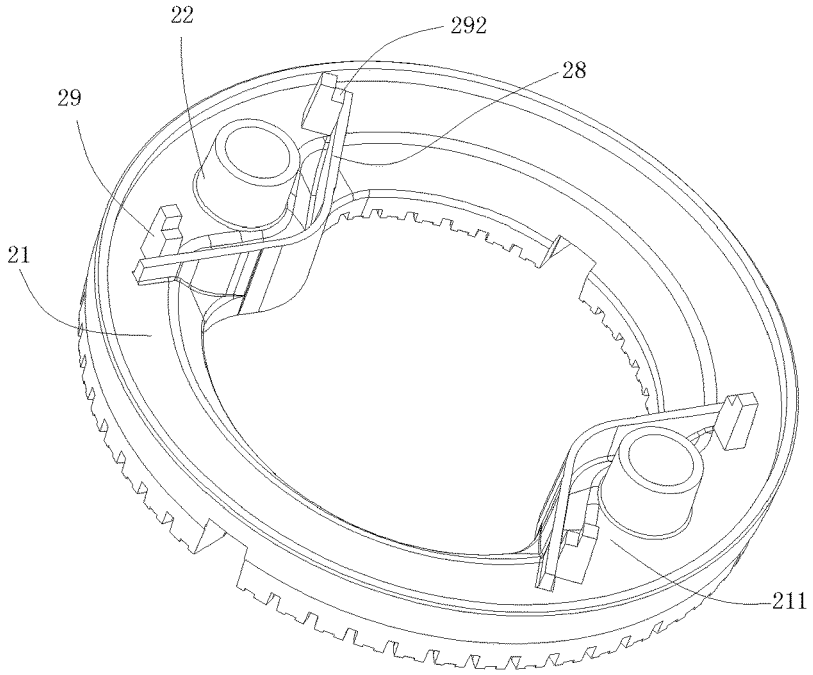
FIG. 5 is a schematic perspective view of a flame distributor of the burner illustrated in FIG. 1.

Referring to FIG. 5, in some embodiments, the bottom cup 10 is provided with two cup portions 16, and the two nozzles 14 are provided in the cup portions 16 respectively. The flame distributor 20 includes two blocking hems 28, and the two blocking hems 28 are corresponding to and flush with top edges 16*a* of the two cup portions 16. The bottom cup 10 or the flame distributor 20 includes a spacer configured to space the two blocking hems 28 apart from the top edges 16*a* so as to form the gap 23.

In the present embodiment, the cup portion 16 has a basically triangle bowl shape and defines an arrival space 16*b* therein. Thus, the primary air may enter the arrival space 16*b* through the gap 23. Each cup portion 16 extends upwards at an opening edge thereof to form a flange 16*c*, and a top portion of the flange 16*c* is configured as the top edge 16*a*.

The spacer includes a plurality of protrusions 29 extending downwards from the blocking hem 28, and the plurality of protrusions 29 are fitted with the top edges 16*a* in shape and structure, such that the flame distributor 20 may be erected on the bottom cup 10 through the plurality of protrusions 29. Specifically, the protrusion 29 is provided with a stepped surface 292 configured to be fitted with the top edge 16*a*.

It could be understood that, the spacer 29 is not limited to the present embodiment, and other shapes and structures may be adopted according to requirements in other embodiments. For example, in another embodiment, the spacer may include a plurality of protrusions which extend upwards from the top edges 16*a* and fitted with the blocking hems 28 in shape and structure, so as to erect the flame distributor 20.

In order to cooperate with the shape of the top edge 16*a*, the blocking hem 28 is configured as an arc wall surrounding the venturi tube 22. In some embodiments, a dimension of the blocking hem 28 is larger than that of the top edge 16*a*.

Thus, the blocking hem 28 completely covers the cup portion 16, such that water on a gas stove may be prevented from being splashed into the cup portion 16 from up to down.

In some embodiments, the venturi tube 22 extends into the cup portion 16.

Thus, a distance between the venturi tube 22 and the nozzle 14 may be shortened, to improve efficiency of the fuel gas being sprayed into the venturi tube 22. Moreover, a relatively closed environment may be provided for mixing the fuel gas with the primary air.

Certainly, a fit relationship between the bottom cup 10 and the flame distributor 20 is not limited to the present embodiment, and other appropriate structures may be adopted according to requirements.

Figure 6:
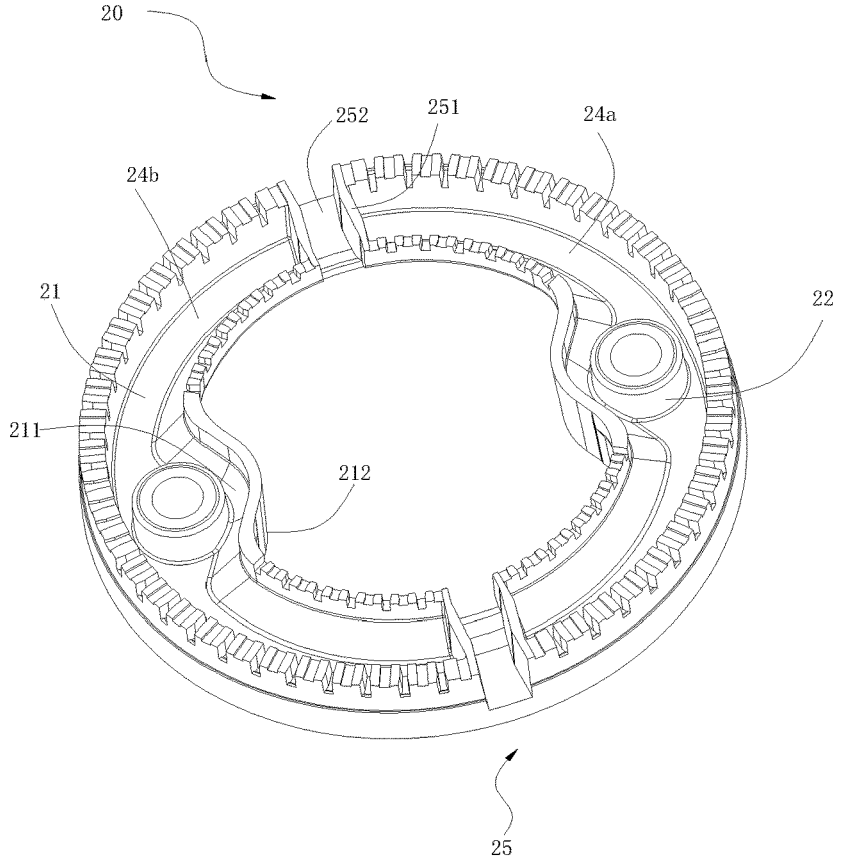
FIG. 6 is a schematic perspective view of a flame distributor of the burner illustrated in FIG. 1 from another viewing angle.

Referring to FIGS. 5-6, in the present embodiment, the flame distributor 20 includes a partition board 21. The partition board 21 has a substantially circular ring shape, and is provided with two island portions 211 extending inwards at two ends along a diameter direction thereof. The two venturi tubes 22 are respectively arranged at the two island portions 211 and configured to pass through the two island portions 211. Openings of the venturi tube 22 at two ends thereof are respectively located at two sides of the partition board 21. The island portion 211 has an arc edge 212 protruded inwards. The blocking hem 28 extends downwards from the arc edge 212.

In the present embodiment, the flame distributor 20 includes two partition structures 25 disposed in the mixing chamber 24, to divide the mixing chamber 24 into two separate sub-chambers 24*a* and 24*b*. The two venturi tubes 22 are respectively communicated with the two sub-chambers 24*a* and 24*b*.

Specifically, the partition structure 25 includes two partition walls 251 extending in the mixing chamber 24 along a radial direction of the flame distributor 20, and a through groove 252 is defined between the two partition walls 251.

Certainly, the partition structure 25 is not limited to the present embodiment, and in other embodiments, the partition structure 25 may be configured according to requirements.

The venturi tube 22 is disposed at a middle position between the two partition structures 25. For example, the venturi tube 22 is located at a middle position of the corresponding sub-chamber 24*a* (or 24*b*), thereby improving the supply effect of the mixed gas.

In the present embodiment, the gas input passage 12 may include two separate sub-passages, and the two nozzles 14 are respectively provided to the two separate sub-passages.

Thus, a dimension of the flame ring corresponding to each sub-passage may be adjusted by separately controlling the fuel gas supplies of the two sub-passages.

Figure 7:
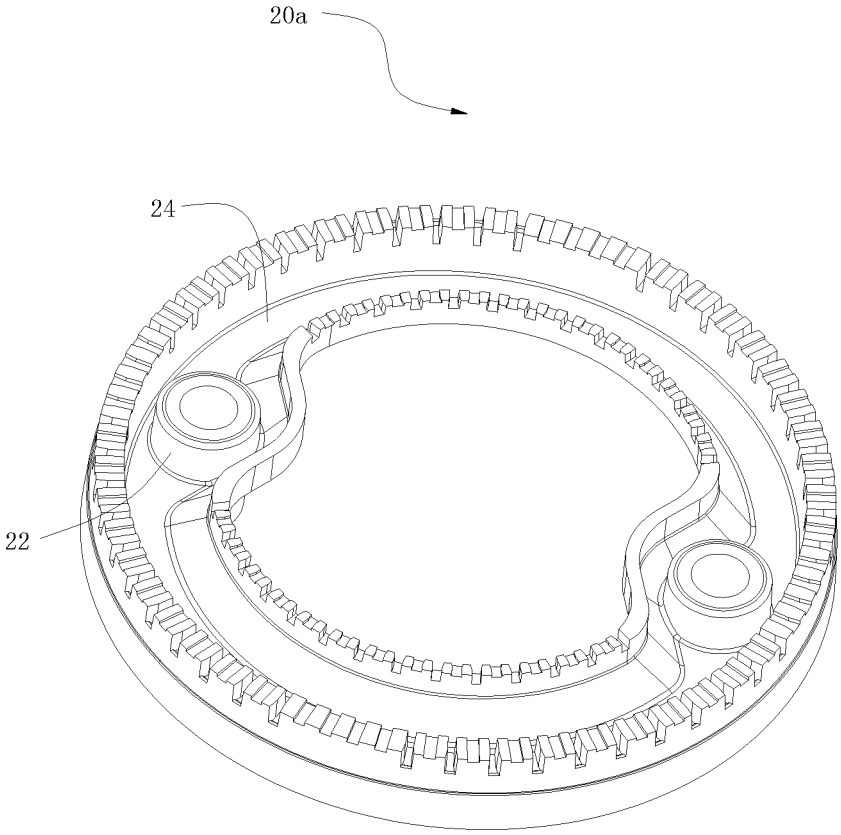
FIG. 7 is a schematic perspective view of a flame distributor according to another embodiment of the present disclosure.

Referring to FIG. 7, in other embodiments, the mixing chamber 24*a* of the flame distributor 20 is not provided with a partition structure 25 therein. Thus, the mixing chamber 24*a* is configured as a single chamber, and does not include sub-chambers.

Certainly, the mixing chamber 24*a* is not limited to the present embodiment, and may be configured in other embodiments according to requirements.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A burner, comprising:

a bottom cup having a gas input passage and two nozzles communicated with the gas input passage and arranged upwards;

a ring-shaped flame distributor disposed to the bottom cup and comprising two venturi tubes respectively opposite to the two nozzles, the flame distributor being spaced apart from the bottom cup to define a gap therebetween, such that a primary air is allowed to enter the two venturi tubes through the gap to mix with a fuel gas sprayed into the two venturi tubes from the two nozzles so as to form a mixed gas, the flame distributor being provided with a ring-shaped mixing chamber communicated with the venturi tubes, and having a notch formed at a top portion of the flame distributor and communicated with the mixing chamber; and a burner cover disposed to the flame distributor, the burner cover being configured to cover the mixing chamber and limit the notch to define an outlet of the mixed gas, thereby forming a flame ring;

wherein the flame distributor comprises two partition structures disposed in the mixing chamber and configured to divide the mixing chamber into two separate sub-chambers, and the two venture tubes are respectively communicated with the two sub-chambers.

2. The burner according to claim 1, wherein the gas input passage is configured to have a straight line shape, and the flame distributor presents a circular-ring shape, a middle axis of the gas input passage passes through a center axis of the flame distributor, and the two nozzles are respectively disposed at two sides of the center axis of the flame distributor.

3. The burner according to claim 1, wherein the gas input passage is substantially Y-shaped and comprises two end points, the flame distributor presents a circular-ring shape, a connection line between the two end points passes through a center axis of the flame distributor, and the two nozzles are disposed at the two end points respectively.

4. The burner according to claim 3, wherein the gas input passage further comprises a connection passage connecting the two end points with each other.

5. The burner according to claim 1, wherein the two nozzles and the two venturi tubes are vertically disposed.

6. The burner according to claim 1, wherein the bottom cup comprises two cup portions, the two nozzles are provided in the cup portions respectively, the flame distributor comprises two blocking hems, and the two hems are corresponding to and flush with top edges of the two cup portions respectively, the bottom cup or the flame distributor comprises a spacer configured to space the two blocking hems apart from the top edges of the two cup portions.

7. The burner according to claim 6, wherein a dimension of the blocking hems is larger than that of the top edges of the bottom cup.

8. The burner according to claim 1, wherein the venturi tube extend into the cup portion.

9. The burner according to claim 1, wherein the gas input passage comprises two separate sub-passages, and the two nozzles are respectively disposed to the two separate sub-passages.

10. The burner according to claim 1, wherein the flame distributor further comprises a partition board with substantially circular ring shape, the partition board is provided with two island portions extending inwards at two ends along a diameter direction of the flame distributor; the two venturi tubes are respectively arranged at the two island portions and configured to pass through the two island portions.

* * * * *